US005779093A

United States Patent [19]

Poole et al.

[11] Patent Number: 5,779,093

[45] Date of Patent: Jul. 14, 1998

[54] PAINT CAN GUARD

[76] Inventors: Trent A. Poole, 59 Country Corners Rd.; Alan G. Bonneau, 88 Rambling Rd., both of South Amherst, Mass. 01002; James R. Labrie, 66 Gunn Rd., Southampton, Mass. 01073

[21] Appl. No.: 717,547

[22] Filed: Sep. 20, 1996

[51] Int. Cl.[6] ..... B65D 5/00

[52] U.S. Cl. ..... 220/698; 220/700

[58] Field of Search ..... 220/695, 698, 220/700, 701, 697

[56] References Cited

U.S. PATENT DOCUMENTS

| | | | |
|---|---|---|---|
| D. 328,864 | 8/1992 | Grunzweig | D9/447 |
| D. 341,082 | 11/1993 | Barnett | D9/434 |
| 2,756,899 | 7/1956 | Crandall | 220/698 X |
| 2,873,881 | 2/1959 | Nichols | 220/698 X |
| 3,326,409 | 6/1967 | Speer | 220/698 |
| 3,469,735 | 9/1969 | Burt | 220/701 X |
| 3,543,287 | 11/1970 | Henkel | 220/698 |
| 3,595,431 | 7/1971 | Bird | 220/90 |
| 3,744,671 | 7/1973 | Saunders, Jr. | 220/698 |
| 3,811,606 | 5/1974 | Higgins | 222/570 |
| 3,913,785 | 10/1975 | Pattershall | 220/354 |
| 4,020,968 | 5/1977 | Chiavola et al. | 220/698 |
| 4,890,807 | 1/1990 | Desjardins | 220/697 X |
| 5,193,705 | 3/1993 | McCallum et al. | 220/319 |
| 5,316,169 | 5/1994 | Gallagher | 220/355 |
| 5,568,879 | 10/1996 | Koyathana | 220/700 X |

*Primary Examiner*—Steven M. Pollard
*Attorney, Agent, or Firm*—Wolf, Greenfield & Sacks, P.C.

[57] ABSTRACT

A paint can guard is mounted on a sealing rim of a paint can. The paint can guard includes an annular rim guard for covering the sealing rim of the paint can, an annular brush wiper having an inner surface and an outer surface, and a plurality of struts coupled between the rim guard and the wiper for supporting the wiper in spaced relation to the rim guard. A substantially annular passage is defined between the outer surface of the wiper and the rim guard. Paint from a brush wiped on the wiper may flow on the inner surface of the wiper into the paint can. The brush can also be wiped on the upper or lower edge of the wiper. Paint that drips or spills outwardly of the wiper may flow through the passage between the outer surface of the wiper and the rim guard into the paint can, thus avoiding spillage.

19 Claims, 3 Drawing Sheets

PAINT CAN GUARD

FIELD OF THE INVENTION

This invention relates to a paint can guard for mounting on a sealing rim of a paint can and, more particularly, to a paint can guard for controlling paint spillage from a paint brush when the brush is dipped into a paint can and is wiped on the paint can rim.

BACKGROUND OF THE INVENTION

A paint can typically includes a sealing rim at its top edge. The sealing rim has a groove for engaging the annular flange of a cover. In normal use, a paint brush is dipped into the paint in the paint can and then is wiped on the sealing rim to remove excess paint prior to application on a surface. No matter how carefully this is done, paint almost always drips into the groove in the sealing rim and/or on the outer surface of the paint can. As a result, paint drips down around the bottom of the paint can and creates a mess. When the cover is replaced on the paint can and the sealing rim has residual paint from the wiping process, paint splatters and spills from the can. Even if the sealing rim is cleaned prior to replacement of the cover, residual paint dries in the groove and makes it difficult to remove the cover at a later time.

A removable cover for a paint container rim is disclosed in U.S. Pat. No. 3,811,606 issued May 21, 1974 to Higgins. The disclosed device covers the paint can sealing rim and includes an inwardly sloping surface, so that excess paint flows back into the can. The cover also includes outer circumferential grooves and notches for directing spilled paint back into the can. The system of grooves and notches is unlikely to be able to accommodate the excess paint that almost invariably spills on the outer edge of a brush wiping surface.

SUMMARY OF THE INVENTION

According to the present invention, a paint can guard for mounting on a sealing rim of a paint can is provided. The paint can guard comprises an annular rim guard for covering the sealing rim of the paint can, an annular brush wiper having an inner surface and an outer surface, and a plurality of struts supporting the wiper in spaced relation to the rim guard, thereby defining a substantially annular passage between the outer surface of the wiper and the rim guard. Paint from a brush wiped on the wiper may flow on the inner surface of the wiper into the paint can. Paint that drips or spills outwardly of the wiper may flow through the passage between the outer surface of the wiper and the rim guard into the paint can, thus avoiding spillage.

The rim guard may include a top wall for covering the sealing rim of the paint can, an inside wall joined to the top wall and an outside wall joined to the top wall. At least a portion of the top wall may be sloped downwardly toward the substantially annular passage. The top wall may include a raised annular ridge at or near its outer periphery. An inside surface of the outside wall may include at least one inwardly extending projection, such as an annular lip, for engaging the paint can.

The inner surface of the wiper includes an upper edge and a lower edge and may be sloped downwardly and inwardly between the upper and lower edges to define a frustoconical surface. The lower edge of the wiper may be located inwardly of the rim guard, and the upper edge of the wiper may be located above the rim guard. The substantially annular passage between the wiper and the rim guard has a width selected to cause wicking of paint into the paint can.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
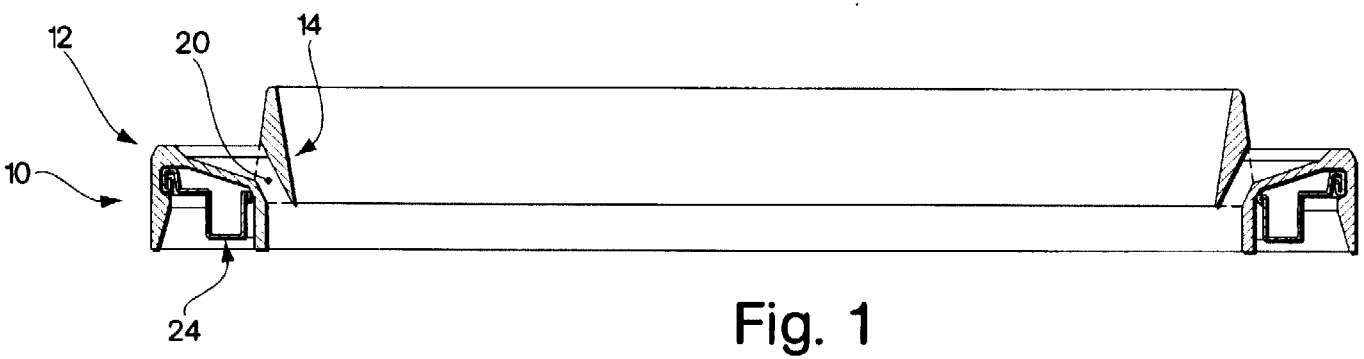
FIG. 1 is a cross-sectional elevation view of an example of a paint can guard in accordance with the invention.
Figure 2:
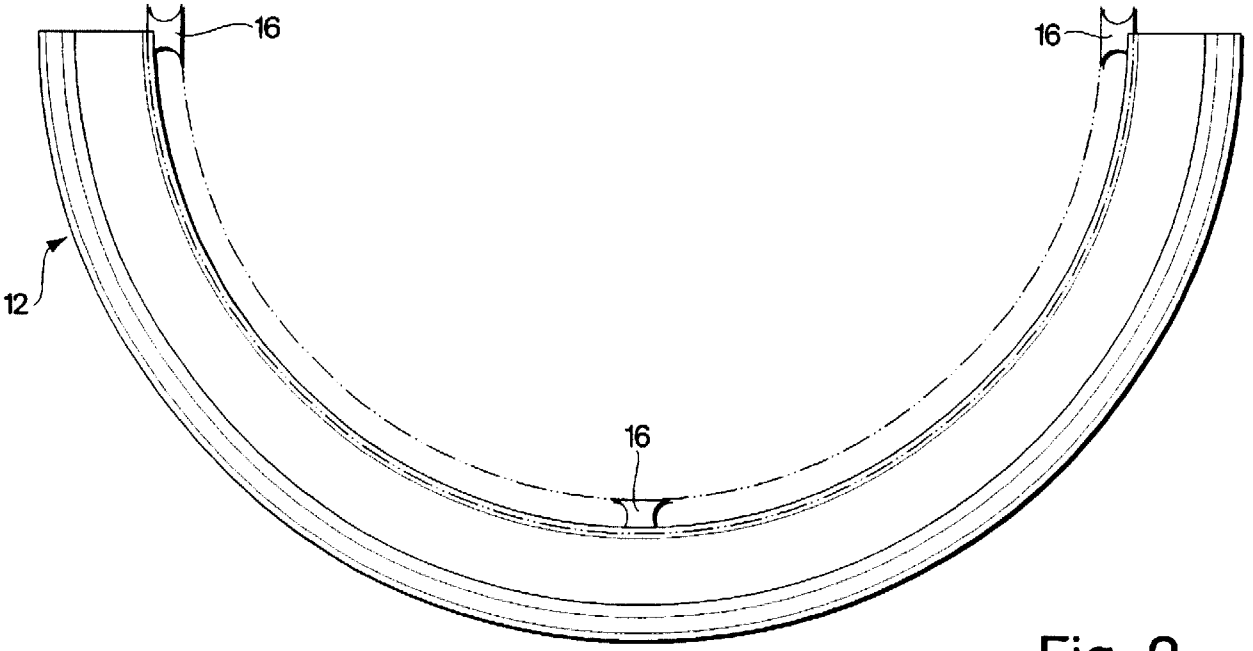
FIG. 2 is a partial top view of the paint can guard of FIG. 1.
Figure 3:
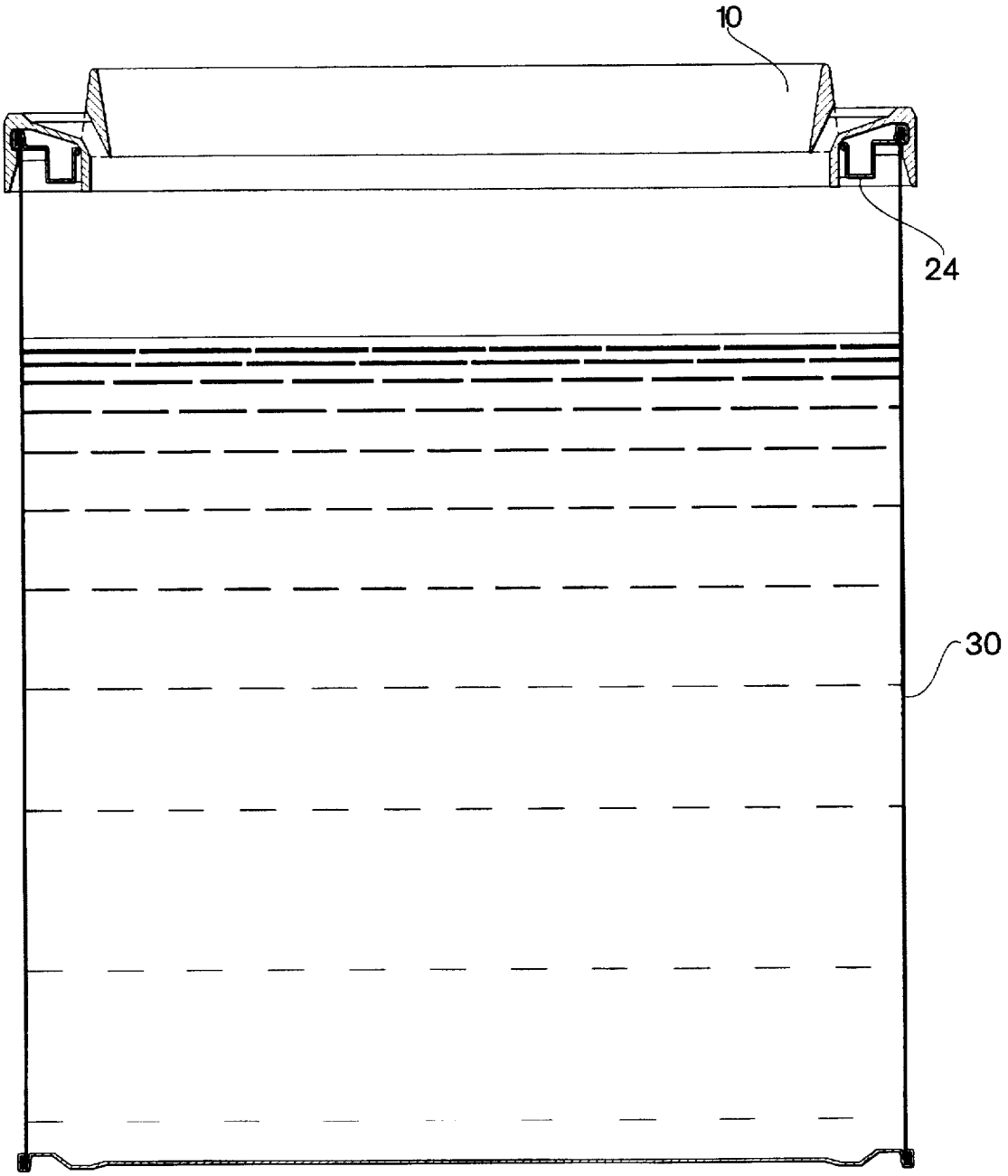
FIG. 3 is a cross-sectional view of the paint can guard mounted on a paint can.

An example of a paint can guard in accordance with the invention is shown in FIGS. 1–4. A paint can guard 10 includes an annular rim guard 12 and an annular brush wiper 14. The wiper 14 is spaced from rim guard 12 by struts 16 to define a substantially annular passage 20 between wiper 14 and rim guard 12. The paint can guard 10 is mounted on a sealing rim 24 of a paint can 30 (FIG. 3).

The paint can guard 10 is mounted on the top of paint can 30 after the cover (not shown) is removed. A paint brush (not shown) is dipped into the paint can 30 and is loaded with paint. The brush is then wiped prior to application. The brush may be wiped on the inner surface of wiper 14, on the upper or lower edge of wiper 14, or on some combination of these. The wiper 14 is located above the sealing rim 24, so that paint conveniently drains from the brush and returns to the paint reservoir within the can 30. Paint may drain from the brush on both sides of wiper 14. The primary drainage is along the inner surface of wiper 14, while a lesser, secondary drainage occurs along the outer surface. As discussed below, drainage of paint along the outer surface of wiper 14 returns to the paint can 30 through substantially annular passage 20.

Figure 4:
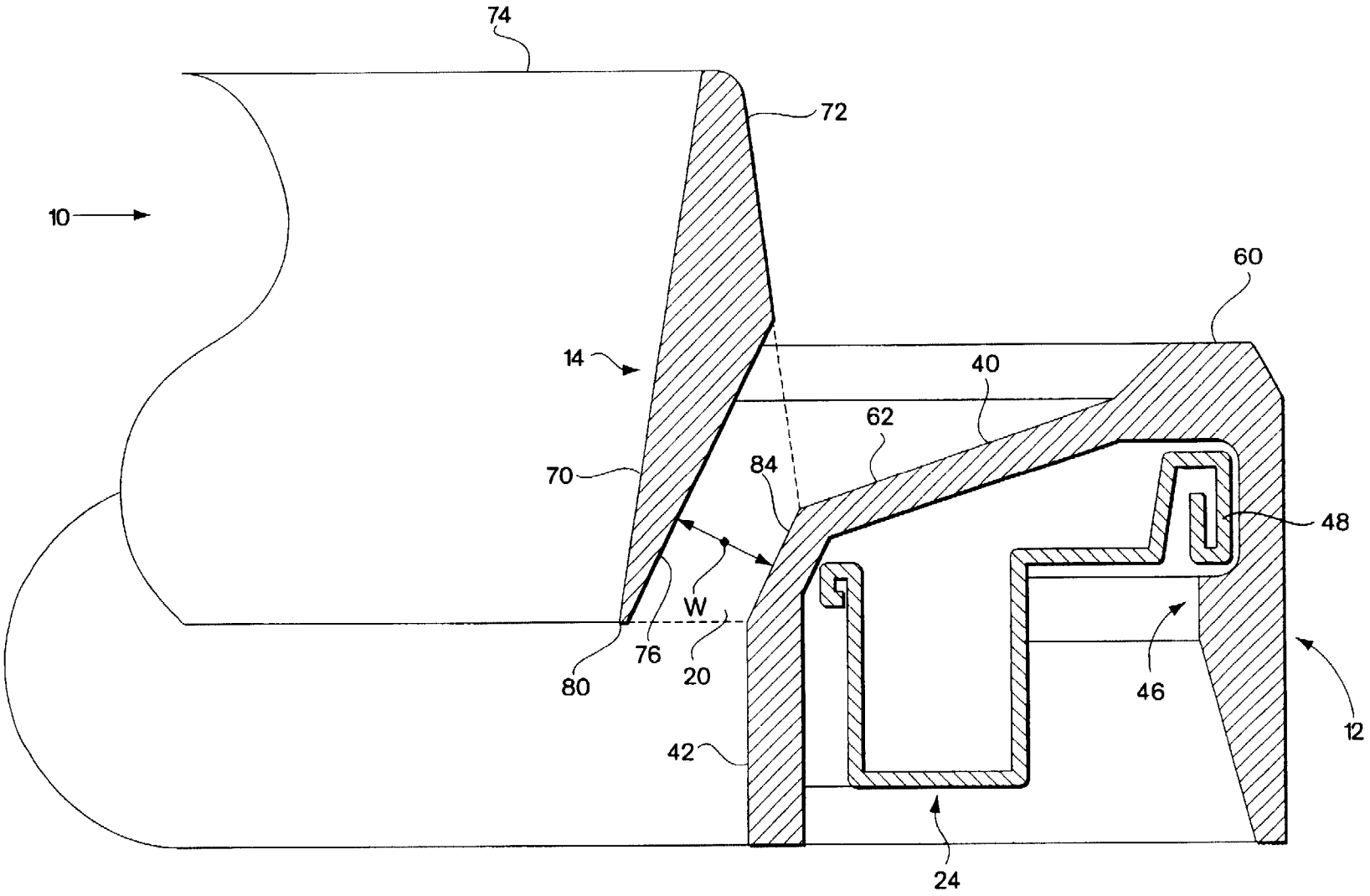
FIG. 4 is an enlarged partial cross-sectional view of the paint can guard.

Referring now to FIG. 4, the rim guard 12 includes a top wall 40, an inside wall 42 joined to top wall 40, and an outside wall 44 joined to top wall 40. A cross-section of the rim guard 12 may have an approximately inverted U shape. When rim guard 12 is mounted on sealing rim 24, top wall 40 covers sealing rim 24, inside wall 42 is located inwardly of sealing rim 24 and outside wall 44 is located outwardly of sealing rim 24. In a preferred embodiment, an inside surface of outside wall 44 is provided with an inwardly-extending annular lip 46 that engages a crimp 48 on sealing rim 24. The annular lip 46 permits the paint can guard 10 to be snapped onto the paint can and to be securely retained on the paint can during use. An alternative to annular lip 46 is a plurality of inwardly-extending projections spaced around the circumference of the inside surface of outside wall 44. Top wall 40 may be provided with an upwardly-extending, raised annular ridge 60 at or near its outer periphery and a sloping surface 62 inwardly of ridge 60. The ridge 60 helps to prevent paint that drips or spills on top wall 40 from flowing over the outside edge of the paint can. Sloping surface 62 directs any spilled paint toward annular passage 20. In a preferred embodiment, sloping surface 62 has an angle of about 20° with respect to horizontal and therefore has a frustoconical shape. The rim guard 12 effectively covers sealing rim 24 and prevents paint from reaching sealing rim 24.

The brush wiper 14 includes an inner surface 70, a first outer surface 72 and a second outer surface 76. Inner surface 70 and outer surface 72 meet at an upper edge 74. Outer surface 76 meets inner surface 70 at a lower edge 80. Outer surface 76 of wiper 14 forms an inner annular wall of passage 20. The wiper 14 has an approximately wedge-shaped cross section. It will be noted that the lower edge 80 of wiper 14 is spaced inwardly from rim guard 12 and that upper edge 74 is located above rim guard 12. This helps to ensure that paint flows from wiper 14 into the paint can and to ensure that the paint brush is unlikely to contact rim guard 12. Inner surface 70 slopes inwardly and downwardly from upper edge 74 to lower edge 80 and thereby forms a frustoconical surface. In a preferred embodiment, inner surface 70 is sloped at an angle of about 10° with respect to vertical.

As indicated above, the brush wiper 14 and the rim guard 12 are spaced apart to define annular passage 20. The passage 20 is interrupted by struts 16 and thus is not fully annular. More specifically, passage 20 is defined by sloping outer surface 76 of wiper 14 and a sloping surface 84 of rim guard 12. In a preferred embodiment, the surfaces 76 and 84 are parallel and are sloped at about 25° with respect to vertical. The passage 20 provides a wicking effect between the wiper 14 and the rim guard 12. As spilled paint fills the passage 20, it is prevented from flowing up and over rim guard 12 by paint wicking between the annular passage surfaces. As the passage becomes fully loaded, the weight of the paint overcomes the viscous adhesion forces to passage wall surfaces 76 and 84 and forces the paint to flow by gravity back into the paint can. The passage 20 can have various widths W to accommodate different paint viscosities, such as thin oil based paints and stains, and heavy latex water based paints. Typically, a 0.125 inch spacing between surfaces 76 and 84 is satisfactory for oil based and latex paint, while a 0.250 inch spacing may be used for a heavy seal coating latex paint. It will be understood that different passage widths are included within the scope of the present invention. The width W of passage 20 is typically in a range of about 0.125 inch to 0.250 inch, but is not limited to this range.

As indicated above, the wiper 14 is attached to rim guard 12 by struts 16. In a preferred embodiment, four struts spaced apart by 90° are utilized. However more or fewer struts may be utilized. The struts should be relatively thin to maximize the annular extent of passage 20 and to thereby facilitate flow of paint back into the can. However, the struts should have sufficient strength and rigidity to support brush wiper 14 during use.

The paint can guard is generic in geometry and can be scaled to any desired paint can size, such as 5 gallon, 1 gallon, quart, pint, etc. Preferably, paint can guard 10 is fabricated as a one-piece unit and may be fabricated by rapid injection molding techniques. One preferred material is an elastomer with material that is compatible with water based and oil based paints. Hydrophobic thermoplastic elastomers such as polyurethane and polypropylene are readily available. One preferred material is a modified polyphenylene oxide (PPO). This material is available under the trade name Noryl and is commercially available from General Electric Company. Noryl provides excellent heat resistance and toughness, and the crystalline nylon phase resists oils, gasoline and solvents. Additional desirable characteristics include low moisture absorption, dimensional stability and low cost.

An optional element of the paint can guard is a circumferential notch or a plurality of evenly spaced dimples on the outside wall of rim guard 12 to accommodate a dust cover (not shown) for the temporary protection of the paint can contents. In addition, a paint brush holder (not shown) and/or other accessories can be attached to the notch or dimple mounting feature.

While there have been shown and described what are at present considered the preferred embodiments of the present invention, it will be obvious to those skilled in the art that various changes and modifications may be made therein without departing from the scope of the invention as defined by the appended claims.

We claim:

1. A paint can guard for mounting on a sealing rim of a paint can, comprising:

an annular rim guard for covering the sealing rim of said paint can;

an annular brush wiper having an inner surface and an outer surface; and a plurality of struts supporting said wiper in spaced relation to said rim guard, thereby defining a substantially annular passage between the outer surface of said wiper and said rim guard, said annular passage having substantially parallel, frustoconical walls that slope inwardly and downwardly and having a width selected to cause wicking of said paint into said paint can, wherein paint from a brush wiped on said wiper may flow on the inner surface of said wiper into said paint can and may flow through said passage between the outer surface of said wiper and said rim guard into said paint can.

2. A paint can guard as defined in claim 1 wherein said rim guard includes a top wall for covering the sealing rim of said paint can, an inside wall joined to said top wall and an outside wall joined to said top wall.

3. A paint can guard as defined in claim 2 wherein at least a portion of said top wall is sloped downwardly toward said substantially annular passage.

4. A paint can guard as defined in claim 2 wherein said top wall includes a raised annular ridge at or near its outer periphery.

5. A paint can guard as defined in claim 2 wherein an inside surface of said outside wall includes at least one inwardly-extending projection for engaging said paint can.

6. A paint can guard as defined in claim 2 wherein the outside wall of said rim guard includes at least one projection for securing an accessory.

7. A paint can guard as defined in claim 1 wherein said wiper has a wedge-shaped cross section.

8. A paint can guard as defined in claim 1 wherein the inner surface of said wiper includes an upper edge and a lower edge and is sloped downwardly and inwardly between said upper and lower edges to define a frustoconical surface.

9. A paint can guard as defined in claim 8 wherein the lower edge of said inner surface is located inwardly of said rim guard.

10. A paint can guard as defined in claim 1 wherein the outer surface of said wiper forms an inner annular wall of said passage.

11. A paint can guard as defined in claim 1 wherein the passage between said wiper and said rim guard has a width in a range of about 0.125 inch to 0.250 inch.

12. A paint can guard as defined in claim 1 wherein said wiper has an upper edge that is located above said rim guard.

13. A paint can guard as defined in claim 1 wherein said rim guard has a cross-section with a generally inverted U-shape.

14. A paint can guard as defined in claim 1 wherein said rim guard has a diameter selected to fit a standard paint can size.

15. A paint can guard for mounting on a sealing rim of a paint can, comprising:

an annular rim guard for covering the sealing rim of said paint can;

an annular brush wiper including an upper edge, a lower edge and an inner surface sloped downwardly and inwardly between said upper and lower edges, the lower edge of said wiper being located inwardly of said rim guard; and a plurality of struts coupled between said rim guard and said brush wiper for supporting said wiper in spaced relation to said rim guard, thereby defining a substantially annular passage between an outer surface of said wiper and said rim guard, said annular passage having substantially parallel, frustoconical walls that slope inwardly and downwardly and having a width selected to cause wicking of said paint into said paint can, wherein paint from a brush wiped on said wiper may flow through said passage between the outer surface of said wiper and said rim guard into said paint can.

16. A paint can guard as defined in claim 15 wherein the passage between said wiper and said rim guard has a width in a range of about 0.125 inch to 0.250 inch.

17. A paint can guard as defined in claim 15 wherein said rim guard includes a top wall for covering the sealing rim of said paint can, an inside wall joined to said top wall and an outside wall joined to said top wall.

18. A paint can guard as defined in claim 17 wherein at least a portion of said top wall is sloped downwardly toward said substantially annular passage.

19. A paint can guard as defined in claim 17 wherein said top wall includes a raised annular ridge at or near its outer periphery.

* * * * *